US005278527A

United States Patent [19]

Kenoun et al.

[11] Patent Number: 5,278,527

[45] Date of Patent: Jan. 11, 1994

[54] DIELECTRIC FILTER AND SHIELD THEREFOR

[75] Inventors: Robert Kenoun, Prospect Heights; Darioush Agahi-Kesheh, Buffalo Grove, both of Ill.

[73] Assignee: Motorola, Inc., Schaumburg, Ill.

[21] Appl. No.: 916,048

[22] Filed: Jul. 17, 1992

[51] Int. Cl.[5] ..... H01P 1/20

[52] U.S. Cl. .....333/202; 333/206BB, 206, 222

[58] Field of Search ..... 333/202, 202

[56] References Cited

U.S. PATENT DOCUMENTS

| | | | |
|---|---|---|---|
| 4,742,562 | 5/1988 | Komusrusch | 333/206 |
| 4,954,796 | 9/1990 | Green et al. | 333/206 |
| 5,023,580 | 6/1991 | Kim et al. | 333/202 |
| 5,130,682 | 7/1992 | Agahi-Kesneh et al. | 333/202 |
| 5,130,683 | 7/1992 | Agahi-Kesneh et al. | 333/202 |
| 5,173,672 | 12/1992 | Heine | 333/202 |
| 5,177,458 | 1/1993 | Newell et al. | 333/206 |
| 5,225,799 | 7/1993 | West et al. | 333/202 |

FOREIGN PATENT DOCUMENTS

| | | | |
|---|---|---|---|
| 403254202 | 11/1991 | Japan | 333/202 DB |
| 8909498 | 10/1989 | PCT Int'l Appl. | 333/202 DB |
| 2165098 | 4/1986 | United Kingdom | 333/202 DB |
| 2236432 | 4/1991 | United Kingdom | 333/202 DB |

*Primary Examiner*—Raymond A. Nelli

*Attorney, Agent, or Firm*—Robert H. Kelly

[57] ABSTRACT

A filter assembly comprised of a dielectric filter and a shield positioned about the dielectric filter. The dielectric filter may be surface-mounted upon a circuit board and includes at least one notch formed to extend along a side face surface thereof. The shield is integrally formed of two sheets of an electromagnetic wave-absorptive material interconnected by a shoulder forming a right angle to fit about two sides of the dielectric filter. At least one projecting prong, corresponding in number and position with the at least one notch of the dielectric filter, extends beyond an end surface of one of the sheets of the shield to interfittingly engage with a corresponding notch formed on the filter. The shield is positioned about the dielectric filter prior to tuning of the filter, and openings are formed to extend through the shield to permit access to the dielectric filter to permit tuning thereof once the shield is positioned thereabout.

20 Claims, 9 Drawing Sheets

150

DIELECTRIC FILTER AND SHIELD THEREFOR

BACKGROUND OF THE INVENTION

The present invention relates generally to dielectric filters, and, more particularly, to a filter assembly having a dielectric filter and an electromagnetic wave-absorptive shield affixed thereto which is permitting of surface mounting of the filter upon a substrate.

Advancements in the field of radio electronics have permitted the introduction and commercialization of an ever-increasing array of radio communication apparatus. Advancements in electronic circuitry design have also permitted increased miniaturization of the electronic circuitry comprising such radio communication apparatus. As a result, an ever-increasing array of radio communication apparatus comprised of ever-smaller, electronic circuitry has permitted the radio communication apparatus to be utilized more conveniently in an increased number of applications.

A radio transceiver, such as a radio transceiver utilized in a cellular, communication system, is one example of radio communication apparatus which has been miniaturized to be utilized in an increased number of applications. Additional efforts to miniaturize further the electronic circuitry of such radio transceivers, as well as other radio communication apparatus, are being made. Such further miniaturization of the radio transceivers will further increase the convenience of utilization of such apparatus, and will permit such apparatus to be utilized in further increased numbers of applications.

Pursuant to such efforts to miniaturize further the electronic circuitry comprising radio transceivers, as well as other radio communication apparatus, size miniaturization of the electronic circuitry comprising such is a critical design goal during circuit design.

Dielectric block filters, comprised of a ceramic material, frequently comprise a portion of the circuitry of such radio transceivers. Dielectric block filters are advantageously utilized as such filters exhibit good filter characteristics at frequencies at which such transceivers usually are operative.

To form a filter of a block of dielectric material, holes are molded, or otherwise formed, to extend through the dielectric block, and sidewalls defining such holes are coated with an electrically-conductive material, such as a silver-containing material. The holes formed thereby form resonators which resonate at frequencies determined by the lengths of the holes.

Typically, substantial portions of the outer surfaces of the dielectric block are similarly coated with the electrically-conductive material. Such portions of the outer surfaces are typically coupled to an electrical ground.

Spaced-apart portions of a top surface of the dielectric block are also typically coated with the electrically-conductive material which is electrically isolated from the electrically-conductive material coated upon other outer surfaces of the dielectric block. Adjacent portions of the electrically-conductive material coated upon the top surface become capacitively coupled theretogether. Additionally, such portions capacitively load respective ones of the resonators.

The resonators, due to the electromagnetic coupling between adjacent ones of the resonators, the portions of the top surface of the block (due to capacitive coupling), and the capacitive loading of the resonators together define a filter having filter characteristics for filtering a signal applied thereto.

In actual dielectric block filters, electromagnetic intercoupling exists not only between adjacent resonators of the filter, but additionally, between nonadjacent ones of the resonators. The intercoupling between the nonadjacent ones of the resonators is generally undesired, and, frequently, some type of electromagnetic wave-absorptive material configured to form a shield is positioned proximate to top surfaces of such dielectric block filters. Such shields are operative to minimize the undesired intercoupling between nonadjacent resonators. To operate properly, such shields are grounded to the same electrical ground potential as the electrical ground to which the dielectric block filters are connected. And, most simply, the shields may be affixed, or otherwise connected, directly to the filters.

However, when connected to a dielectric block filter, the shield alters the filter characteristics of the filter.

After construction of a dielectric block filter, the filter is tuned by removing portions of the coating of the electrically-conductive material. Such tuning corrects for manufacturing variances, and is typically performed to alter slightly the filter characteristics of the filter. Conventionally, the filter is placed in a supportive fixture, the filter characteristics of the untuned filter are determined, and then the filter is tuned to be of desired filter characteristics. Once the filter has been tuned by such a process, the filter is removed from its supportive positioning in the supportive fixture, a shield is affixed to the filter, and the filter is placed upon a circuit board and connected to an electrical circuit to which the filter then forms a portion. But, as noted hereinabove, the shield alters the filter characteristics of the filter; hence, the filter characteristics of the filter, once the shield is affixed thereto, differs somewhat with the filter characteristics of the filter, as originally tuned.

Such variance between the tuned, filter characteristics and the filter characteristics of the filter after affixation of the shield to the filter can result in undesired performance of a circuit to which the filter forms a portion.

What is needed, therefore, is a shield for a dielectric filter, and a filter assembly including such, which may be affixed to the dielectric filter prior to tuning thereof.

Automation of circuit assembly is effectuated by the use of reflow solder techniques. Dielectric block filters which may be surface-mounted upon a circuit board permit affixation of such filters to the circuit board by a reflow solder technique. Use of dielectric filters which may be surface-mounted therefore advantageously facilitates automation of circuit assembly.

For a filter to be surface-mountable, the face surface of the dielectric block filter which seats upon the circuit board must be flat. Accordingly, a shield which is affixed to the dielectric block filter must be of a construction permitting affixation thereof to the filter while still permitting the bottom face surface of the dielectric block filter to be of a flat configuration.

What is further needed, therefore, is a filter assembly comprised of a dielectric block filter and a shield affixed thereto wherein the filter, after affixation of the shield thereto includes a flat seating surface permitting seating of the filter upon a circuit board, thereby to permit affixation of the filter assembly to an electrical circuit disposed upon the circuit board by a reflow solder technique.

SUMMARY OF THE INVENTION

The present invention, accordingly, advantageously provides a shield for a dielectric filter and a dielectric filter assembly including such, which may be affixed to the dielectric filter prior to the tuning thereof.

The present invention further advantageously provides a filter assembly comprised of a dielectric filter and an electromagnetic wave-absorptive shield affixed thereto which may be surface mounted upon a substrate.

The present invention further advantageously provides a dielectric filter assembly for circuitry disposed in a radio transceiver, such as the radio receiver circuitry of the radio transceiver.

The present invention includes further advantages and features, the details of which will become more apparent by reading the detailed description of the preferred embodiments hereinbelow.

In accordance with the present invention, therefore, a filter assembly for generating a filter signal responsive to application of an input signal thereto is disclosed. The filter assembly comprises a dielectric filter formed of a block of ceramic material which is defined by a top surface, a bottom surface, and opposing side surfaces. The block of ceramic material has at least one resonator formed to extend along a longitudinal axis between the top and bottom surfaces of the block, a coating of electrically-conductive material formed upon at least portions of the bottom and opposing side surfaces of the block, and at least one notch formed to extend along at least one of the opposing side surfaces of the block. A shield formed of an electromagnetic wave-absorptive material includes a first sheet portion having a face surface for seating upon one of the side surfaces of the block forming the dielectric filter. A second sheet portion is positioned to extend at an angle beyond a side edge surface of the first sheet portion for covering portions of the top surface of the block forming the dielectric filter. At least one projecting prong is positioned to extend at an angle beyond an edge surface of the second sheet portion wherein the at least one projecting prong seats, in interfitting engagement, with the at least one notch formed upon the at least one of the opposing side surfaces of the block forming the dielectric filter.

BRIEF DESCRIPTION OF THE DRAWINGS

The present invention will be better understood when read in light of the accompanying drawings in which.

DESCRIPTION OF THE PREFERRED EMBODIMENTS

At the outset, it is to be noted that, although the following description of the exemplary embodiments is discussed in connection with a multiple-pole and zero bandpass filter, such description is by way of example only. (Such type of filter is also oftentimes referred to as an "elliptical" filter.) The teachings of the present invention may similarly be embodied with other types of filters, including, without way of limitation, high pass filters, low pass filters, and duplexer filters.

Figure 1:
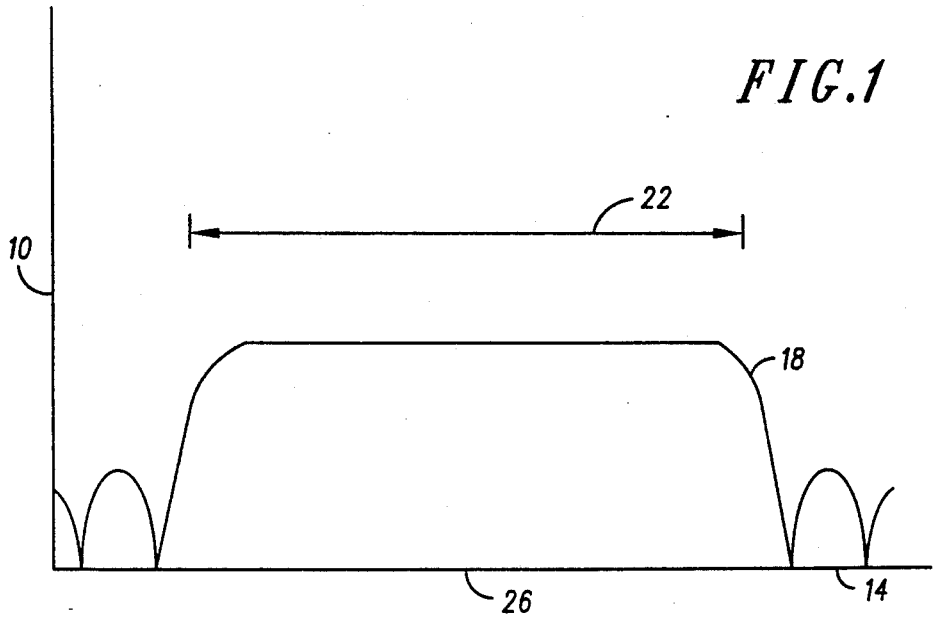
FIG. 1 is a graphical representation of the frequency response of a filter which comprises a portion of the filter assembly of a preferred embodiment of the present invention.

Turning first to the graphical representation of FIG. 1, the frequency response of a multiple-pole and zero, bandpass, dielectric filter is graphically represented. Ordinate axis 10 is scaled in terms of a power-related value, here decibels, and abscissa axis 14 is scaled in terms of frequency, here hertz. Curve 18 is a plot of the frequency response of the filter. The frequency response of the bandpass filter defines a passband indicated by line segment 22 pictured above curve 18. End points of segment 22 are determined by the upper and lower passband cutoff frequencies of the filter. The passband of the filter is characterized not only by upper and lower passband cutoff frequencies, but additionally by a center frequency, indicated in the figure by reference numeral 26. The center frequency 26 is located at the center of the passband, and, hence, is determinative of the midpoint of segment 22.

As noted previously, a dielectric filter, typically comprised of a block of ceramic material, is frequently utilized in circuits operative at radio frequencies.

During filter construction of a dielectric filter forming a bandpass filter, a passband of desired characteristics is attempted to be duplicated. However, due to manufacturing variances, the frequency response of the resultant dielectric filter oftentimes varies somewhat from the desired frequency response. To obtain the desired frequency response, fine-tuning of the filter after construction thereof, as noted hereinabove, is oftentimes effectuated by removing portions of the coating of the electrically-conductive material formed upon portions of the outer surfaces of the dielectric filter.

As further noted hereinabove, an electromagnetic wave-absorptive shield is oftentimes positioned about the dielectric filter to absorb electromagnetic wave emanations generated during operation of the dielectric filter. (The shield is also operative to absorb undesired, electromagnetic wave emanations transmitted to the filter). Such electromagnetic wave emanations can cause undesired intercoupling between nonadjacent one of the resonators of a dielectric filter. Because the shield absorbs the electromagnetic wave emanations, the shield is operative to minimize such undesired intercoupling.

Affixation of such electromagnetic wave-absorptive shield to a dielectric filter, however, affects the frequency response of the dielectric filter. For instance, with respect to the graphical representation of FIG. 1, the upper and lower cut off frequencies determinative of the end points of segment 22, as well as the center frequency 26 of the frequency response of the filter, represented by curve 18, may be altered by the affixation of the shield to the filter. The dielectric filter assembly of the preferred embodiment of the present invention advantageously permits affixation of the shield to the dielectric filter prior to tuning of the filter. Such affixation of the shield to the filter prior to tuning permits the variance of the filter characteristics of the filter caused by such affixation to be considered, and accounted for, during tuning of the filter. Hence, undesired circuit performance as a result of unanticipated variance in filter characteristics due to affixation of the shield to the filter after tuning is avoided.

Figure 2:
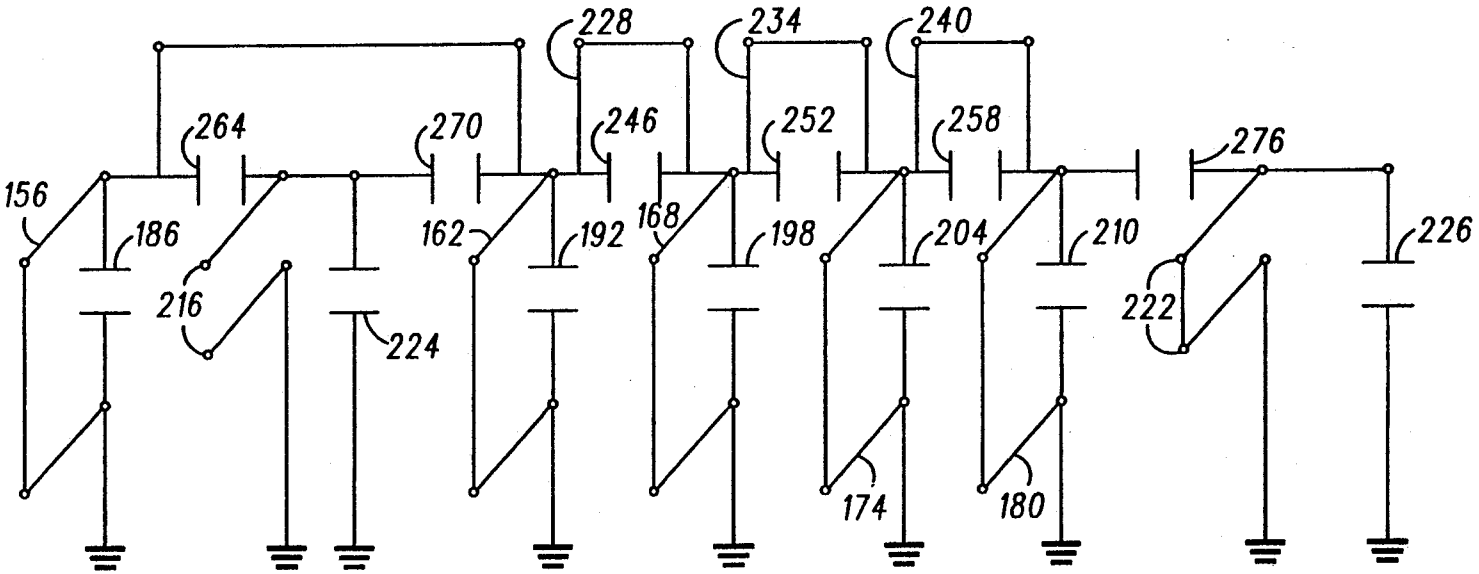
FIG. 2 is an electrical schematic of a filter which comprises a portion of the dielectric filter assembly of a preferred embodiment of the present invention.

FIG. 2 is an electrical schematic diagram of a dielectric filter forming a portion of a preferred embodiment of the present invention which has a frequency response of a bandpass filter, such as that shown in the graphical representation of FIG. 1.

The duplexer filter, referred to generally in the figure by reference numeral 150, is an elliptical, multi-pole filter constructed to have a frequency response of a desired passband and a center frequency. It is to be noted, of course, that filter 150 is representative of an exemplary embodiment of the present invention; many other filters of other circuit configurations, and other single-and multi-pole filter circuits may be constructed according to the teachings of the preferred embodiment of the present invention.

Filter 150 includes a plurality of resonators, here designated by transmission lines 156, 162, 168, 174, and 180. The resonator indicated by transmission line 156 is capacitively loaded by capacitor 186. Similarly, resonators indicated by transmission lines 162, 168, 174, and 180 are capacitively loaded by capacitors 192, 198, 204, and 210, respectively, through an electrical ground plane.

The resonator represented by the transmission line 156 is configured to form a transfer function zero while the resonators indicated by transmission lines 162–180 are configured to form transfer function poles.

The input terminals of filter 150 are indicated in the figure by line 216, and the output terminal of filter 150 is indicated in the figure by line 222. Capacitive loading to ground of terminals 216 and 22 is indicated in the figure by capacitors 224 and 226.

Adjacent ones of the resonators represented by transmission lines 162–180 are both inductively coupled and capacitively coupled to adjacent ones of the resonators. In the figure, inductive coupling between resonators represented by transmission lines 162 and 168 is indicated in the figure by transmission line 228; inductive coupling between resonators represented by transmission lines 168 and 174 is indicated in the figure by transmission line 234: and inductive coupling between resonators represented by transmission lines 174 and 180 is indicated in the figure by transmission line 240.

Capacitive coupling between resonators represented by transmission lines 162 and 168 is indicated in the figure by capacitor 246; capacitive coupling between resonators represented by transmission lines 168 and 174 is indicated in the figure by capacitor 252; and capacitive coupling between resonators represented by transmission lines 174 and 180 is indicated in the figure by capacitor 258.

In an actual dielectric filter, the amount of capacitive coupling between the adjacent ones of the resonators is proportional to the separation distances separating the electrically-conductive material coated upon the inner surfaces which define the inner conductors of the resonators of the filter 150 (or are formed upon a top surface of the dielectric block, and electrically connected to such inner surfaces).

Capacitors 264 and 270 are further shown in the electrical schematic of filter 150 of FIG. 2 and are representative of input capacitances. Capacitor 276 also forms a portion of filter 150, and is representative of an output capacitance.

While not shown in the figure, in the absence of an electromagnetic wave-absorptive shield positioned about the dielectric filter, inductive coupling also occurs between nonadjacent ones of the resonators. The shield of the electromagnetic wave-absorptive material is operative to minimize such undesired intercoupling. However, as noted hereinabove, affixation of such a shield to a dielectric filter alters the filter characteristics of the filter, and account for such affectation during tuning of the filter is necessary to ensure that the filter be of desired filter characteristics.

Figure 3:
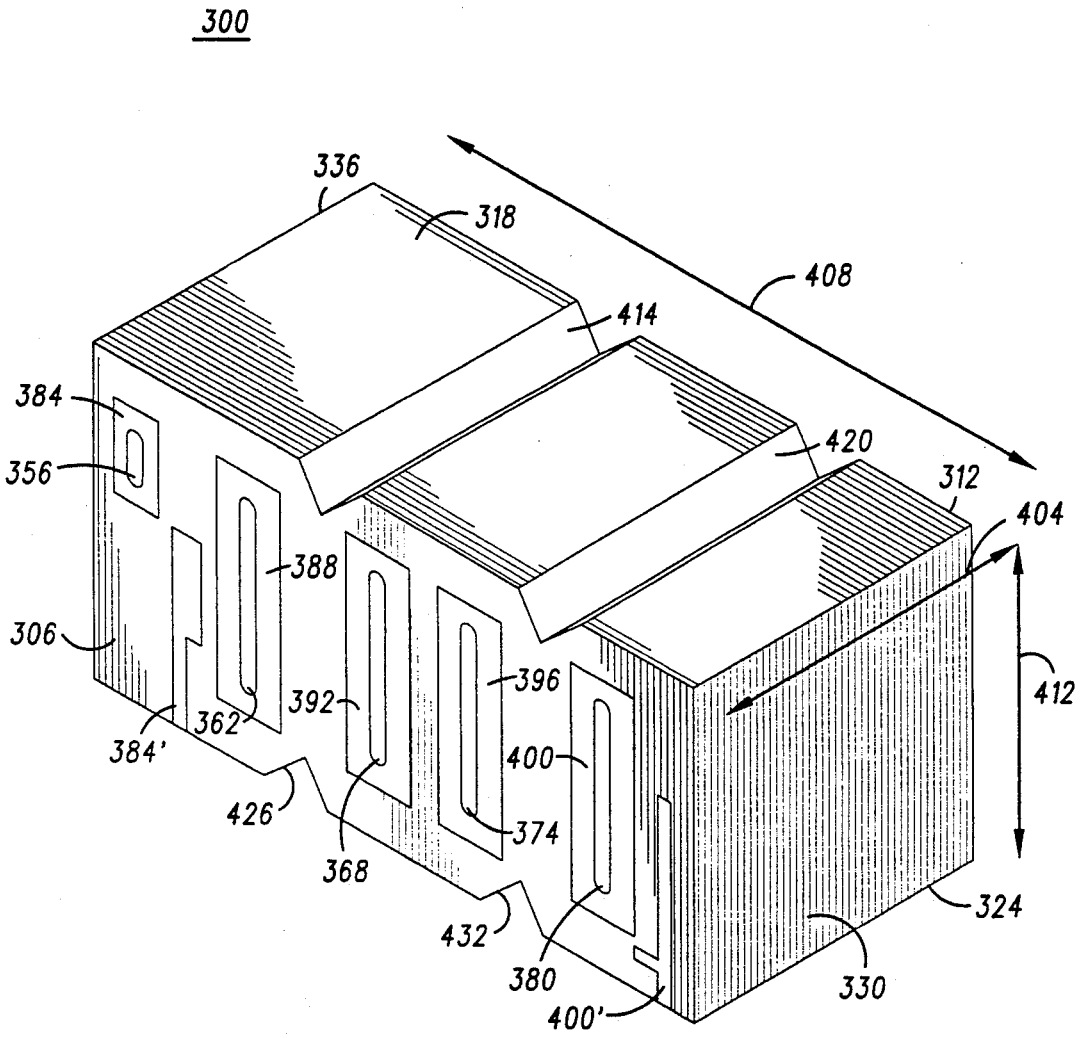
FIG. 3 is a perspective view of a filter which comprises a portion of the filter assembly of a preferred embodiment of the present invention.

Turning next to the perspective view of FIG. 3, a dielectric filter, here referred to generally by reference numeral 350, which forms a portion of the dielectric filter assembly of a preferred embodiment of the present invention, is shown. Filter 350 may be represented schematically by the circuit schematic of filter 150 of FIG. 2. Filter 350 is generally block-like in configuration, and is comprised of a dielectric material.

Filter 300 defines top surface 306, bottom surface 312, front side surface 318, rear side surface 324, and end side surfaces 330 and 336. A coating of an electrically-conductive material, typically a silver-containing material, is applied to substantial portions of bottom surface 312, front and rear side surfaces 318 and 324, and end side surfaces 330 and 336. Such portions of surfaces 312–336 are coupled to an electrical ground plane (as will be noted with respect to FIG. 9 hereinbelow, the coating of the electrically-conductive material applied to rear side surface 324 is applied in a manner to form input and output coupling electrodes thereupon.)

Formed to extend longitudinally along longitudinal axes through the dielectric block by a process of molding or otherwise, are a series of transmission lines, here designated by reference numerals 356, 368, 374, and 380. Transmission lines 356–380 correspond to transmission lines 156–180 of the circuit schematic of filter 150 of FIG. 2. Transmission lines 356–380 form resonating transmission lines when signals of certain frequencies are applied thereto. Transmission lines 356–380 define openings upon top surface 306 of filter 300. The side walls defining transmission lines 356–380 are also coated with the same electrically-conductive material which coats outer surfaces of the dielectric block.

It is noted that, as transmission lines 356–380 form resonating transmission lines or, more simply "resonators," when signals of certain oscillating frequencies are applied thereto, the use of the terms transmission lines and resonators will, at times, be used interchangeably hereinbelow.

Portions of top surface 306 are also coated with the same electrically-conductive material which coats side surfaces of the dielectric block and sidewalls which define transmission lines 356–380. Such portions are indicated in the figure by painted areas 384, 384', 388, 392, 396, and 400. Painted area 384 and 384', 384' and 388, 388 and 392, 392 and 396, 396 and 400, and 400 and 400' are also capacitively coupled theretogether. The amount of capacitive coupling is determined by the size of the painted areas as well as the separation distances between adjacent ones of the painted areas. Respective ones of the painted areas 384, 384', 388, 392, 396, 400, and 400' also capacitively load the resonators to ground.

It is also noted that the configuration of the painted areas upon top surface 306 is for purposes of illustration only. Other configurations, typically more complex, are oftentimes painted upon top surfaces of actual filters.

The dimensions of filter 350 are typically defined in terms of a heighthwise dimension, indicated by line segment 404, a lengthwise dimension, indicated by line segment 408, and a ground plane separation distance, indicated by line segment 408.

The heighthwise dimension of the filter 350 determines the length of resonating transmission lines 356–380 which extend longitudinally through the dielectric block. Such heighthwise dimension of the filter is typically, essentially fixed, as the length of transmission lines 356–380 must be of lengths proportional to the wavelengths of oscillating signals applied to the filter to be passed thereby. (As wavelength is inversely proportional to frequency, the lengths of transmission lines 356–380 are also related, in inverse proportion, to the frequency of signals applied to the filter.)

Dielectric filter 350 is typically coupled to an electrical circuit disposed upon an electrical circuit board. As mentioned previously, dielectric filters which are surface-mountable directly upon the electrical circuit board advantageously facilitate automation of circuit assembly as such dielectric filters may be connected to the electrical circuit by reflow solder techniques.

Dielectric filter 300 of FIG. 3 is of a construction permitting surface mounting of the filter directly upon an electrical circuit board by seating rear side surface 324 upon the circuit board.

In the preferred embodiment, the cross-sections of resonators 362–380 are elongated in directions transverse to their respective longitudinal axes. Such elongation of the transverse axes of the resonators 362–380 alters the amount of coupling between adjacent ones of the resonators.

As described previously, the circuit design goal of miniaturization of electronic circuitry has resulted in the reduction in the physical dimensions of dielectric filters. The physical dimensions (other than the heighthwise dimensions of the filter, for reasons noted above) have been correspondingly reduced.

As the lengthwise dimensions (indicated by line segment 408 in the figure) have been reduced, adjacent ones of the resonators must be positioned in greater physical proximity to one another. By positioning adjacent ones of the resonators in such closer proximity to one another, the amount of coupling between adjacent ones of the resonators is increased.

To counteract for such increase in inter-resonator coupling, portions of the ceramic material of the dielectric block of the filter between adjacent ones of the filter may be removed, by a process of molding or otherwise, as such removal of dielectric material between the adjacent ones of the resonators reduces the amount of inter-resonator coupling.

In the figure, notches 414 and 420 formed to extend along the front side surface 318 and rear side surface 324, respectively. of the filter between resonators 362 and 368 reduce to coupling between such adjacent resonators. Similarly, notches 426 and 432 are formed to extend along front side surface 318 and rear side surface 324 of the filter between resonators 374 and 380 reduce the coupling between such adjacent resonators.

While the positioning of notches upon the front and rear side surfaces 318 and 324, respectively, of the filter are selected according to obtain desired filter characteristics of the filter, formation of at least one notch to extend along rear side surface 324 of the filter is advantageously utilized in the preferred embodiment of the present invention.

Figure 4:
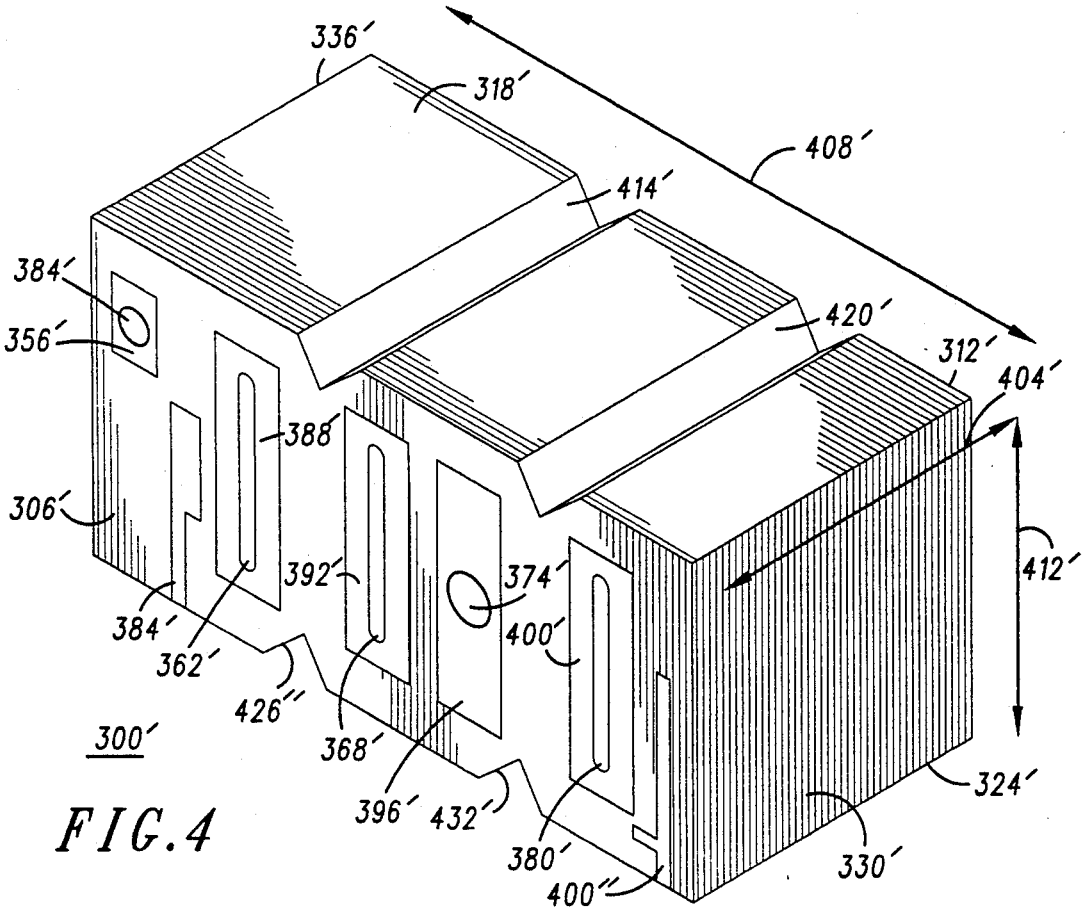
FIG. 4 is a perspective view of a filter, similar to that of FIG. 3., but which forms a portion of the filter assembly of an alternate, preferred embodiment of the present invention.

FIG. 4 is a perspective view of a filter forming a portion of the dielectric filter assembly of an alternate embodiment of the present invention. The filter of this figure, referred to generally by reference numeral 300', is identical in all respects to that of filter 300 of FIG. 3, except in the configuration of one of the transmission lines extending through the dielectric block, here designated by reference numeral 374'. Transmission line 374' is of a circular, cross-sectional configuration. The alteration in the cross-sectional configuration of the transmission line alters the amount of coupling between adjacent transmission lines. As other portions of filter 300' are identical to corresponding portions of filter 300, such portions are similarly numbered and will not again be discussed in detail.

Figure 5:
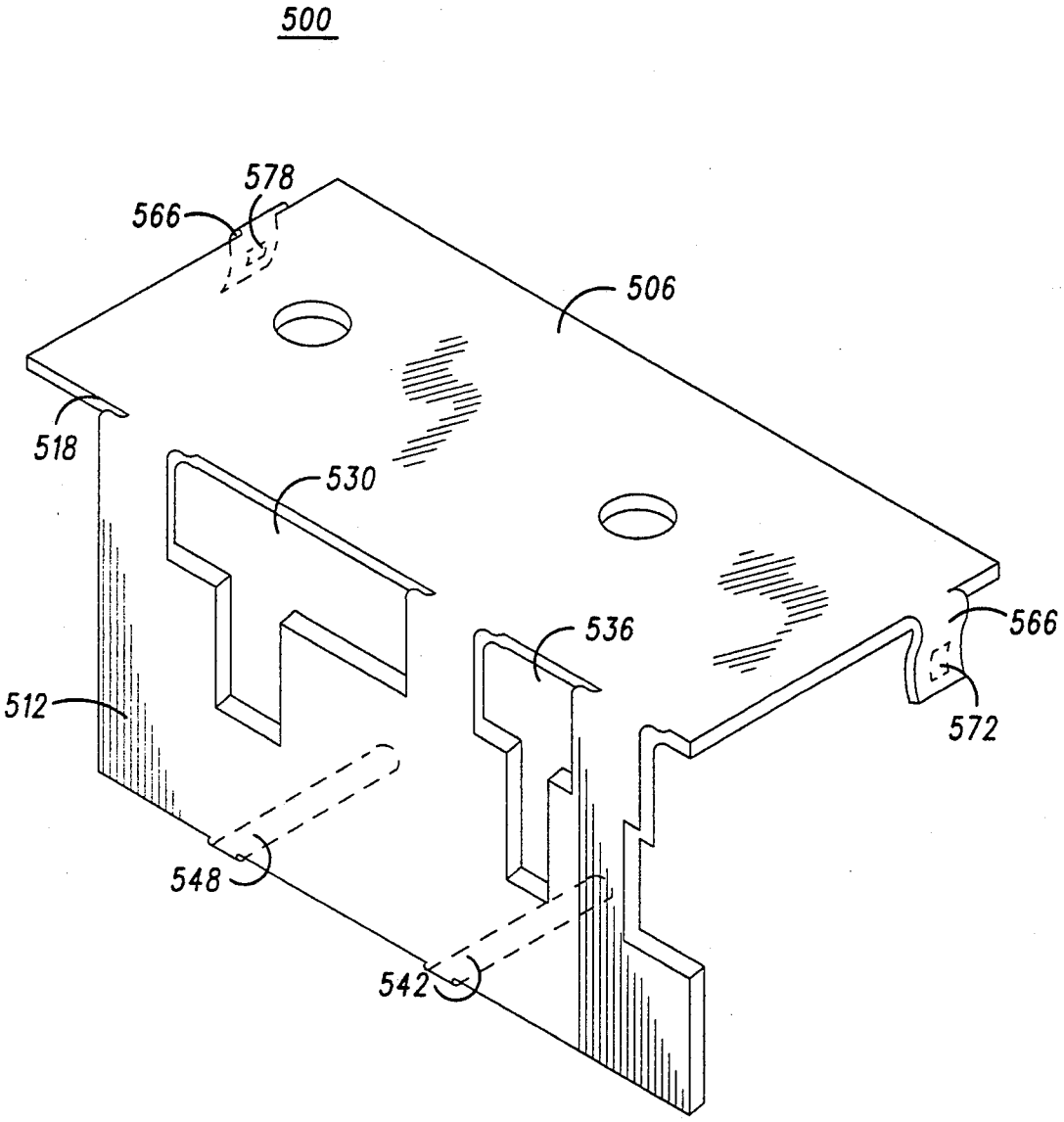
FIG. 5 is a perspective view of a shield, shown in isolation, comprised of an electromagnetic wave-absorptive material of a preferred embodiment of the present invention.
Figure 6:
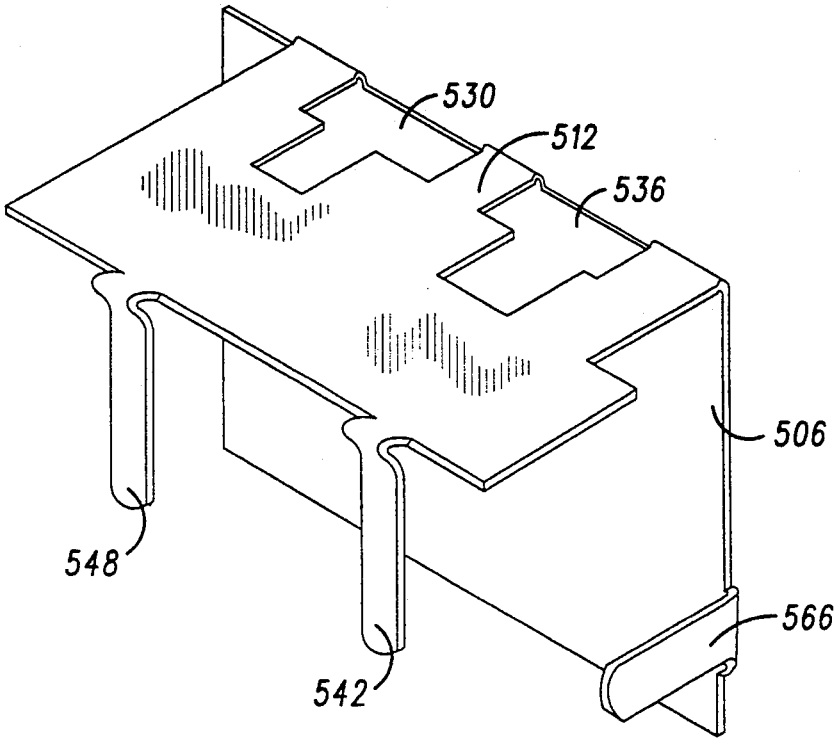
FIG. 6 is a perspective view of the shield of FIG. 5 taken from another angle.

Turning next to the perspective views of FIGS. 5 and 6, a shield, referred to generally by reference numeral 500 is shown. As FIGS. 5 and 6 are both views of shield 500 taken at different angles, the same reference numerals will be utilized to identified common elements of the figures. Shield 500 is formed of an electromagnetic wave-absorptive material, and, in the preferred embodiment, shield 500 is integrally formed of a metallic material.

Shield 500 includes first sheet portion 506 of generally rectangular configuration. As will be noted in greater detail hereinbelow, first sheet portion 506 is of dimensions substantially corresponding to the dimensions of front side surface 318 of filter 300 shown in FIG. 3.

Shield 500 further includes second sheet portion 512 which extends at a substantially perpendicular angle beyond the side edge surface of first sheet portion 506. As first sheet portion 506 and second sheet portion 512 are integrally formed, the intersection therebetween forms a shoulder portion, referred to in the figure by reference numeral 518 having central bight section forming a perpendicular angle. Openings 530 and 536 are formed to extend through second sheet portion 512, and also through a portion of first sheet portion 506.

First and second projecting prongs 542 and 548 formed to extend beyond an edge surface of second sheet portion 512 at a side of sheet portion 512 opposite that of shoulder portion 518. Projecting prongs 542 and 548 extend at angles substantially perpendicular to the planar direction of second sheet portion 512, and are comprised of longitudinally-extending strip members. For reasons which will also be noted in greater detail hereinbelow, the height of second sheet portion 512 of shield 500 substantially corresponds to the height of top surface 306 (as represented by line segment 408) of filter 300 of FIG. 3.

Further shown in the perspective views of FIGS. 5 and 6 are clip members 560 and 566 formed to extend beyond opposing edge surfaces of first sheet portion 506. Clip members 560 and 566 each project at an angle substantially perpendicular to the planar direction of first sheet portion 506 and each include clip-face surface, indicated by pads 572 and 578 in the figure.

Because the dimensions of first sheet portion 506 substantially corresponds to the dimensions of front side surface 318 of filter 300 and second sheet portion 512 is of a height substantially corresponding to the height of top surface 306, shield 500 may be positioned about filter 300 to form thereby a shield to absorb electromagnetic wave emanations generated by the filter 300 during operation thereof.

Figure 7:
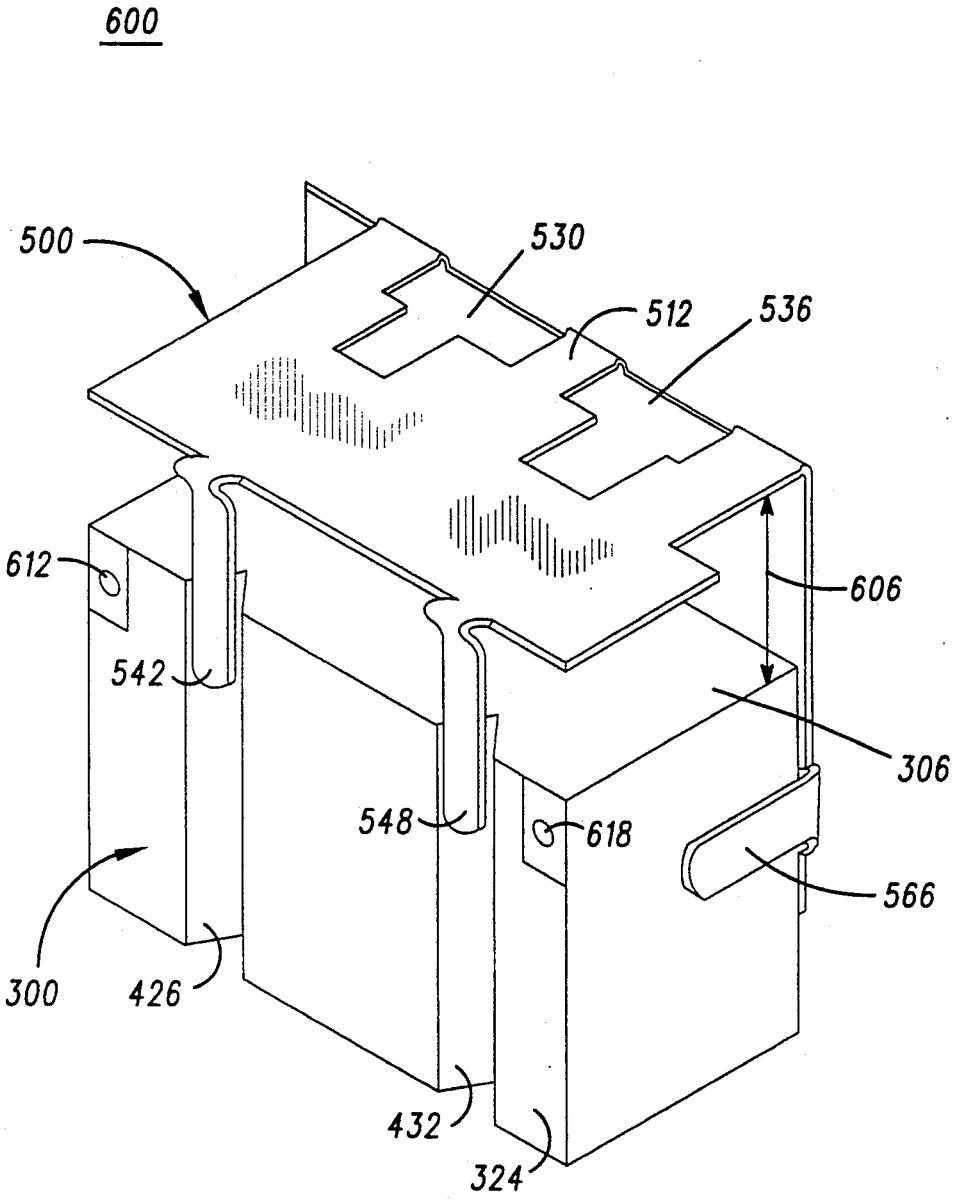
FIG. 7 is a perspective view of the shield of FIGS. 5 and 6 together with the filter of FIG. 3 which together form the filter assembly of a preferred embodiment of the present invention.

FIG. 7 is a perspective view of filter 300 of FIG. 3 taken together with shield 500 of FIGS. 5 and 6. Filter 300 and shield 500 together form the dielectric filter assembly, referred to in the figure by reference numeral 600, of the preferred embodiment of the present invention. As mentioned hereinabove, because of the dimensions of first and second sheet portions 506 and 512 of shield 500, shield 500 may be positioned about filter 300. As illustrated in the figure, first sheet portion 506 seats against front side surface 318 (hidden from view in the orientation of FIG. 7) to cover the front side surface 318 thereby. Clip members 560 and 566 (only clip member 566 is shown in FIG. 7) clippingly engage with end side surfaces 330 and 336 of filter 300.

Because second sheet portion 512 of shield 500 extends at an angle perpendicular to the planar direction defined by first sheet portion 506, second sheet portion 512 covers top surface 306 of filter 300. In contrast to the relationship between first sheet portion 506 and front side surface 318 (hidden from view in FIG. 7) of filter 300 second sheet portion 512 is positioned at an elevation above top surface 306 by distance indicated by line segment 606.

Projecting prongs 542 and 548 which extend beyond an edge side surface of second sheet portion 512 seat against rear side surface 324 of filter 300. More particularly, projecting prongs 542 and 548 interfittingly engage with notches 426 and 432 formed to extend along rear side surface 324. By proper selection of the depths of notches 426 and 432 as well as the thicknesses of prongs 542 and 548, positioning of prongs 542 and 548 in such interfitting engagement with notches 426 and 432 permits seating of the projecting prongs within the notches 426 and 432 such that face surfaces of projecting prongs 542 and 548 are flush with, or are disposed beneath, the face surface of rear side surface 324. Such positioning permits surface mounting of rear side surface 324 upon a substrate, such as a circuit board.

It is noted that, in the view of FIG. 7, input and output terminals 612 and 618 disposed upon rear sides surface 324 of filter 300, are also shown in the figure.

Figure 8:
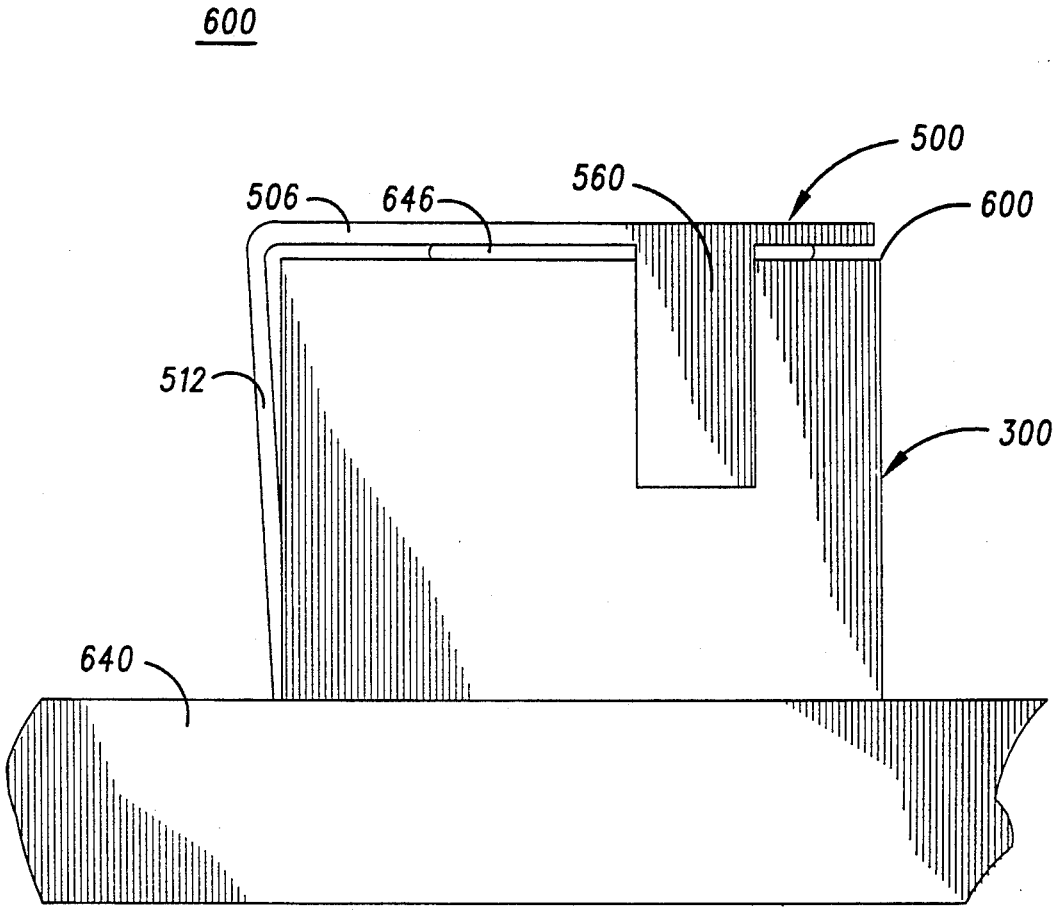
FIG. 8 is a side, elevational view of the filter assembly of FIG. 7 seated upon a substrate, here an electrical circuit board.

Turning next to the side, elevational view of FIG. 8, the dielectric filter assembly 600 of the preferred embodiment of the present invention is shown after seating of the assembly upon a substrate, here circuit board 640. Because projecting prongs 542 and 548 seat in interfitting engagement with notches 426 and 432 of filter 300, rear side surface 324 of filter 300 seats directly against circuit board 640. Because filter assembly 600 may be surface mounted upon circuit board 640, the filter assembly may be coupled to an electrical circuit disposed upon the circuit board by a reflow solder technique. Clip member 560 (and also clip member 566, not shown in the figure) generates a clipping force to clip the shield 500 in position about filter 300. A solder connection may also be effectuated between filter 300 and shield 500 to provide a positive electrical connection therebetween and also to assist in the affixation of shield 500 to filter 300. Such solder connection is indicated in the figure by solder material 646.

Figure 9:
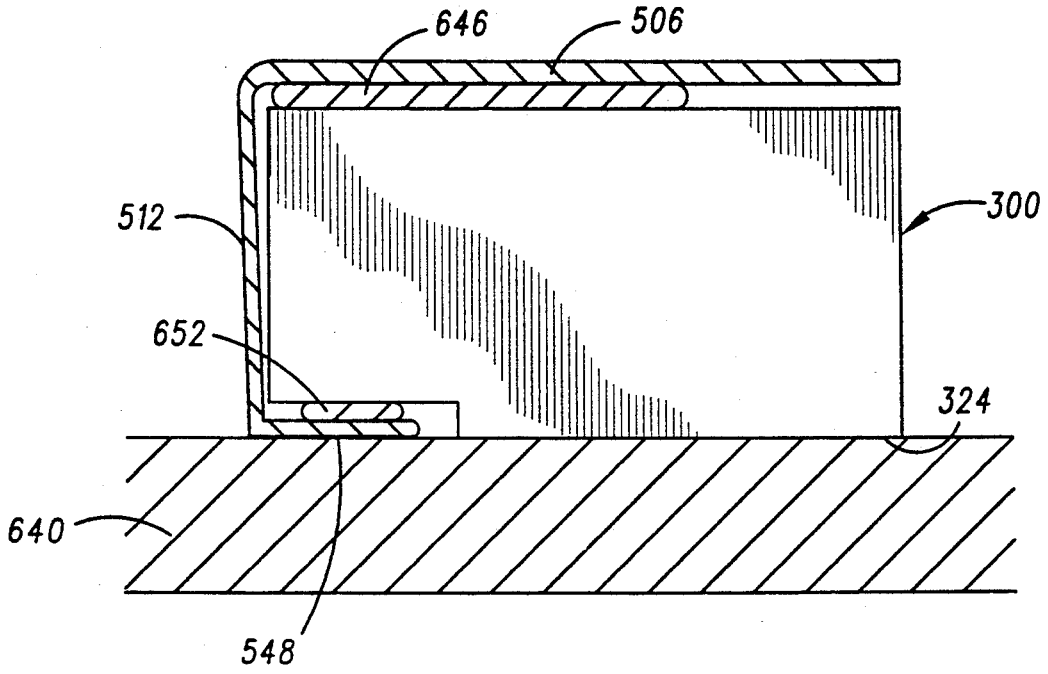
FIG. 9 is a sectional view taken longitudinally through the filter assembly of FIG. 7 illustrating the relationship between the dielectric filter assembly and the substrate when the dielectric filter assembly is seated thereupon.

FIG. 9 is a sectional view taken longitudinally through filter assembly 600 and circuit board 640 of FIG. 8. The sectional view of FIG. 9 again illustrates the relationship between filter 300 and shield 500 of the filter assembly. The relationship between projecting prong 548 of shield 500 and notch 432 of filter 300 is also illustrated in the figure. Because of such interfitting engagement, rear side surface 324 of filter 300 is surface mountable upon a circuit board 640. Solder material 646 forming the solder connection between first sheet portion 506 of shield 500 and a side surface of filter 300 is again shown. Additionally, solder material 652 used to form a solder connection between projecting prong 548 and a surface of filter 300 is also shown. Such solder connection is formed for reasons similar to the reasons for formation of the solder connection formed by solder material 646.

Because openings 530 and 536 are formed to extend through second sheet portion 512, shield 500 may be positioned about filter 300, and affixed thereto, and then subsequently tuned. Openings 530 and 536 permit access to the coating of conductive material formed upon a top surface of the filter 300 thereby to permit tuning of the filter. Once tuning of the filter has been completed, the same shield 500 may be maintained in the affixed position about the filter, and the filter may then be positioned to be connected to an electrical circuit.

Figure 10:
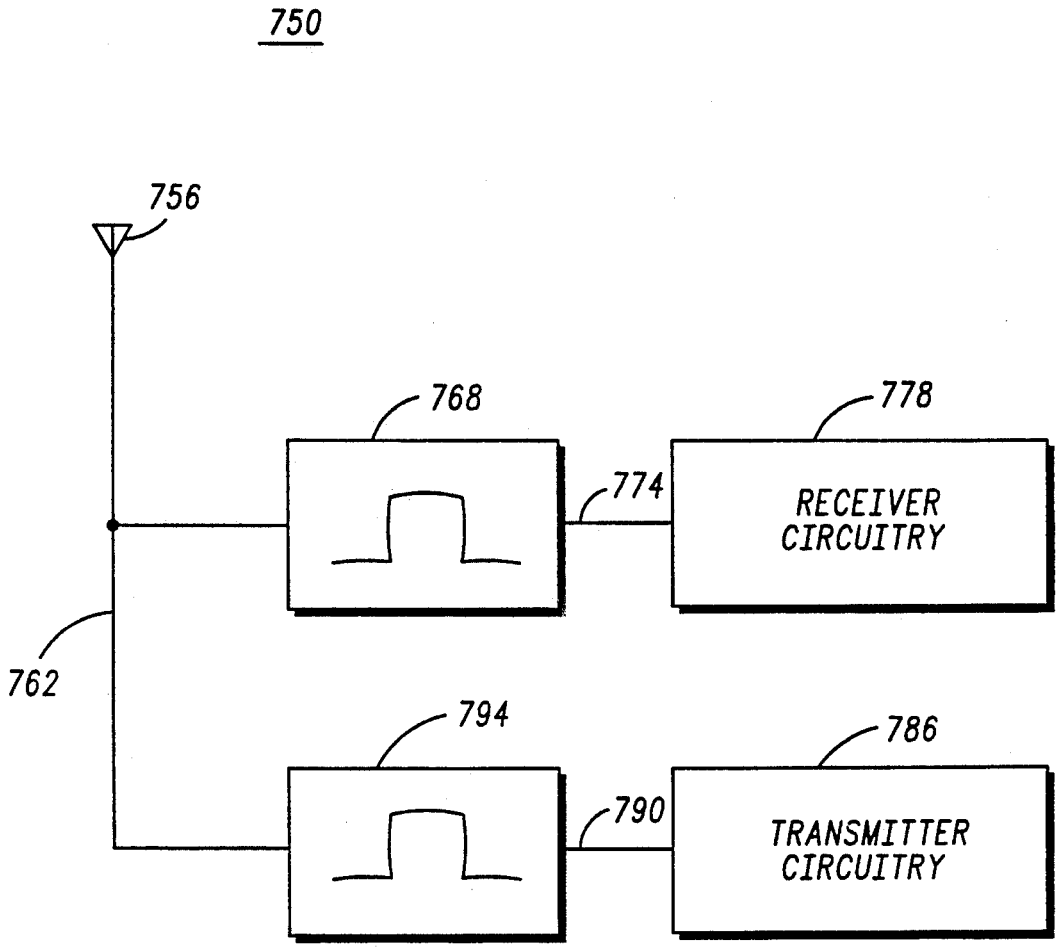
FIG. 10 is a block diagram of a radio transceiver of a preferred embodiment of the present invention in which the filter assembly of the preceding figures forms a portion.

Turning finally now to the block diagram of FIG. 10, a radio transceiver, referred to generally by reference numeral 700, is shown in block form. Radio transceiver 700 is representative, for example, of a radio telephone operative in a cellular, communication system. Radio transceiver 700 includes a filter assembly of the preferred embodiment of the present invention as a portion thereof.

A signal transmitted to transceiver 750 is received by antenna 756, and a signal representative thereof is generated on line 762 and applied to filter 768. Filter 768 generates a filtered signal on line 774 which is applied to receiver circuitry 778. Receiver circuitry 778 performs functions such as down-conversion and demodulation of the received signal, as is conventional. Transmitter circuitry 786 is operative to modulate and up-convert in frequency a signal to be transmitted by transceiver 750, and to generate a signal on line 790 which is applied to filter circuit 794. Filter circuit 794 is operative to generate a filtered signal which is applied to antenna 756 by way of line 762 to be transmitted therefrom.

A filter assembly of a preferred embodiment of the present invention may, for instance, comprise filter 768 of transceiver 750 to be operative to filter a signal received by the transceiver.

While the present invention has been described in connection with the preferred embodiments shown in the various figures, it is to be understood that other similar embodiments may be used and modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. A filter assembly for generating a filtered signal responsive to application of an input signal thereto, said filter assembly comprising:

a dielectric filter formed of a block of ceramic material and defined by a top surface, a bottom surface, and opposing side surfaces, the block of ceramic material having: at least one resonator formed to extend along a longitudinal axis between the top and bottom surfaces, respectively, of the block, a coating of electrically-conductive material formed upon at least portions of the bottom and opposing side surfaces, respectively, of the block, and at least one notch formed to extend along at least one of the opposing side surfaces of the block; and a shield formed of an electromagnetic wave-absorptive material and having: a first sheet portion having a face surface for seating upon one of the side surfaces of the block forming the dielectric filter, a second sheet portion positioned to extend at an angle beyond a side edge surface of the first sheet portion for covering portions of the top surface of the block forming the dielectric filter, and at least one projecting prong positioned to extend at an angle beyond an edge surface of the second sheet portion, the at least one projecting prong for seating, in interfitting engagement, with the at least one notch formed upon the at least one of the opposing side surfaces of the block forming the dielectric filter.

2. The filter assembly of claim 1 wherein said at least one resonator formed to extend between the top and bottom surfaces of the block forming the dielectric filter comprises a first resonator having a cross-section of a circular configuration and a second resonator of a cross-section elongated along an axis which extends in a direction transverse to the longitudinal axis thereof.

3. The filter assembly of claim 1 wherein said shield further comprises a shoulder portion positioned between the first sheet portion and the second sheet portion, the shoulder portion defining a first side section, a second side section, and a central bight section, wherein the first sheet portion is connected to the second side section of the shoulder portion, and the central bight section of the shoulder portion defines the angle at which the second sheet portion extends beyond the first sheet portion.

4. The filter assembly of claim 3 wherein said shoulder portion further includes at least one slotted opening formed along the length thereof.

5. The filter assembly of claim 3 wherein the first sheet portion, the second sheet portion, and the shoulder portion are integrally formed of a metallic material.

6. The filter assembly of claim 1 wherein the second sheet portion of the shield extends at an angle substantially perpendicular to the first sheet portion.

7. The filter assembly of claim 1 further comprising at least one clip member coupled to the first sheet portion at a side edge surface thereof other than the side edge surface of the first sheet portion beyond which the second sheet portion extends.

8. The filter assembly of claim 7 wherein the at least one clip member comprises first and second clip members coupled to opposing side edge surfaces of the first sheet portion.

9. The filter assembly of claim 7 wherein said at least one clip member extends at an angle substantially perpendicular to the first sheet portion such that a face surface of the clip member abuts against a side surface of the block forming the dielectric filter.

10. The filter assembly of claim 9 wherein the at least one clip member and the first sheet portion are integrally formed of a metallic material whereby the at least one clip member electrically connects with the coating of the electrically conductive material formed upon the side surface of the block forming the dielectric filter when the face surface of the clip member abuts thereagainst.

11. The filter assembly of claim 1 wherein said at least one projecting prong extends at an angle substantially perpendicular to the second sheet portion.

12. The filter assembly of claim 1 wherein said at least one notch formed to extend along the at least one opposing side surface of the block extends between the top and bottom surfaces of the block.

13. The filter assembly of claim 1 wherein the at least one projecting prong is of a thickness of a value which is less than a value of a depth of a corresponding notch of the at least one notch formed to extend along the at least one side surface of the block forming the dielectric filter.

14. The filter assembly of claim 13 further comprising a solder material for forming a solder connection to connect electrically the first sheet portion and the coating of the electrically conductive material formed upon the side surface upon which the first sheet portion seats.

15. The filter assembly of claim 13 further comprising a solder material for forming a solder connection to connect electrically the at least one projecting prong and the coating of the electrically conductive material formed upon the side surface having the at least one notch with which the at least one projecting prong interfittingly engages.

16. The filter assembly of claim 1 wherein said at least one notch formed to extend along the side surface of the block comprises first and second, spaced-apart, parallel-extending notches, and said at least one projecting prong of the shield comprises first and second, spaced-apart, parallel-extending projecting prongs.

17. the filter assembly of claim 14 wherein the solder material which forms the solder connection further fastens the first sheet portion and the coating of the electrically-conductive material formed upon the side surface of the block, thereby to affix the second surface portion at a desired elevation above the top surface of the block forming the dielectric filter.

18. An electromagnetic wave-absorption shield for shielding a dielectric filter formed of a block of ceramic material and defined by a top surface, a bottom surface, and opposing side surfaces, wherein at least one of the side surfaces includes at least one notch formed to extend along a surface thereof, said shield having:

a first sheet portion having a face surface for seating upon one of the side surfaces of the block forming the dielectric filter, a second sheet portion positioned to extend at an angle beyond a side edge surface of the first sheet portion for covering portions of the top surface of the block forming the dielectric filter, and at least one projecting prong positioned to extend at an angle beyond an edge surface of the second sheet portion, the at least one projecting prong for seating, in interfitting engagement, with the at least one notch formed upon the at least one of the opposing side surfaces of the block forming the dielectric filter.

19. In a radio receiver having radio receiver circuitry disposed upon a circuit board and operative to receive radio frequency signals transmitted thereto, a combination with the radio receiver circuitry of a filter assembly, said filter assembly comprising:

a dielectric filter formed of a block of ceramic material and defined by a top surface, a bottom surface, and opposing side surfaces, the block of ceramic material having: at least one resonator formed to extend along a longitudinal axis between the top and bottom surfaces, respectively, of the block, a coating of electrically-conductive material formed upon at least portions of the bottom and opposing side surfaces, respectively, of the block, and at least one notch formed to extend along at least one of the opposing side surfaces of the block; and a shield formed of an electromagnetic wave-absorptive material and having: a first sheet portion having a face surface for seating upon one of the side surfaces of the block forming the dielectric filter, a second sheet portion positioned to extend at an angle beyond a side edge surface of the first sheet portion for covering portions of the top surface of the block forming the dielectric filter, and at least one projecting prong positioned to extend at an angle beyond an edge surface of the second sheet portion, the at least one projecting prong for seating, in interfitting engagement, with the at least one notch formed upon the at least one of the opposing side surfaces of the block forming the dielectric filter.

20. A filter assembly surface-mountable upon a circuit board, said filter assembly comprising:

a dielectric filter formed of a block of ceramic material defined by a top surface, a bottom surface, a front side surface, a rear side surface, and first and second end-side surfaces, a resonator extending longitudinally between the top and bottom surfaces, respectively, and a notch formed upon the rear side surface to extend between the top and bottom surfaces of the block; and a shield formed of an electromagnetic wave-absorptive material and having: a first sheet portion having a face surface for seating upon the front side surface of the block forming the dielectric filter, a second sheet portion formed integral with the first sheet portion and positioned to extend at a perpendicular angle beyond a side edge surface of the first sheet portion for covering portions of the top surface of the block forming the dielectric filter, and a projecting prong positioned to extend beyond a side edge surface of the second sheet portion opposite that of the edge surface of the first sheet portion beyond which the second sheet portion extends, the projecting prong for seating, in interfitting engagement with the notch formed to extend along the front side surface of the block forming the dielectric filter.

* * * * *